United States Patent [19]

Agoston

[11] 4,442,905

[45] Apr. 17, 1984

[54] JIG ASSEMBLY FOR DRILLING VERTICALLY UPWARD

[76] Inventor: Edward E. Agoston, 11535 Dunham Rd., Sagamore Hills, Ohio 44067

[21] Appl. No.: 290,682

[22] Filed: Aug. 6, 1981

[51] Int. Cl.[3] ..... E21C 11/00

[52] U.S. Cl. ..... 173/36; 175/37; 408/99; 408/136; 408/712; 248/644

[58] Field of Search ..... 173/34, 36, 37; 248/125, 297.5, 644; 254/106; 408/99, 100, 136, 712

[56] References Cited

U.S. PATENT DOCUMENTS

| | | | |
|---|---|---|---|
| 1,459,195 | 7/1920 | Colombelle . | |
| 1,643,557 | 9/1927 | Goldman | 248/297.5 X |
| 2,234,789 | 12/1938 | Wunderlich . | |
| 2,368,982 | 2/1945 | Guze | 248/125 X |
| 2,405,110 | 7/1945 | Bullock . | |
| 2,440,852 | 2/1945 | Elford . | |
| 2,463,266 | 1/1946 | Habenicht . | |
| 2,477,916 | 10/1946 | Wilhide . | |
| 2,625,063 | 2/1952 | Hanson . | |
| 2,720,125 | 10/1955 | Palik | 408/136 X |
| 2,844,054 | 12/1956 | Bull et al. . | |
| 2,879,677 | 3/1959 | Baublitz . | |
| 2,879,678 | 3/1959 | Kaiser | 408/712 X |
| 2,973,673 | 3/1961 | Grau | 408/712 X |
| 2,994,510 | 8/1961 | Michalak | 254/106 X |
| 3,068,722 | 12/1962 | Carion | 408/136 |
| 3,363,489 | 1/1968 | Heden . | |
| 3,447,454 | 6/1969 | Ratz . | |
| 3,837,757 | 9/1974 | Levine | 408/14 |
| 4,010,943 | 3/1977 | Eft | 269/87.1 |

FOREIGN PATENT DOCUMENTS

| | | | |
|---|---|---|---|
| 2110924 | 9/1972 | Fed. Rep. of Germany | 408/712 |

*Primary Examiner*—Frederick R. Schmidt
*Assistant Examiner*—Robert P. Olszewski
*Attorney, Agent, or Firm*—Maky, Renner, Otto & Boisselle

[57] ABSTRACT

A lightweight portable jig assembly for supporting a power drill and for advancing and retracting the drill towards and away from an overhead workpiece comprises a carriage having a first tubular portion slidable on a tube standard and a second tubular portion within which slides a second tube on which the drill is mounted. A releasable lock mechanism is cooperative relation with the carriage and tube standard prevents downward movement of the carriage on the standard while permitting upward movement of the carriage on the standard whereby the carriage may be selectively positioned on the standard simply by lifting the carriage to the proper vertical height and then released to lock same in place. Advancement and retraction of the drill towards the overhead workpiece is obtained by a manually operable lever and linkage which further is operable to effect automatic release of the releasable lock mechanism upon retraction of the drill.

12 Claims, 5 Drawing Figures

JIG ASSEMBLY FOR DRILLING VERTICALLY UPWARD

DISCLOSURE

This invention relates generally to portable jig assemblies which are used to support and feed power drills in overhead drilling operations.

BACKGROUND OF THE INVENTION

In the installation of trailer hitches on automobiles, trucks or other vehicles, it usually is necessary to drill one or more holes in the vehicle frame. This commonly is done using a hand-held power drill with the drill pressure being applied directly by the drill operator. Drilling the holes in this manner however is both slow and laborious and does not afford precision guidance of the drill. To render matters worse, the vehicle body most often precludes access to the vehicle frame from above. Therefore, the holes must be drilled from underneath the vehicle and this renders such task physically taxing as not only must the drilling pressure be applied upwardly but the weight of the drill must be supported as well.

Various devices for supporting and feeding power drills in overhead drilling operations are known in the patented prior art and examples thereof can be seen in U.S. Pat. Nos. 2,405,110 and 2,879,677.

SUMMARY OF THE INVENTION

This invention provides a lightweight portable jig assembly for supporting a power drill and for advancing and retracting the drill towards and away from an overhead workpiece such as the frame of a vehicle to which a trailer hitch is to be installed. The drill jig assembly minimizes the labor and effort involved in overhead drilling operations and facilitates precision drilling. In addition, the drill jig assembly of this invention is inexpensive and easy to use.

Briefly, the drill jig assembly according to the invention comprises a drill holder and feed mechanism that is carried on a carriage which is slidably mounted on an upright standard. A releasable lock mechanism in cooperative relation with the carriage and standard prevents downward movement of the carriage on the standard while permitting upward movement of the carriage on the standard whereby the carriage may be selectively positioned on the standard simply by lifting the carriage to the proper vertical height and then released to lock same in place. Such arrangement accordingly provides for quick rough height adjustment of the drill prior to advancement of the drill towards the overhead workpiece to drill a hole therein. The releasable lock mechanism may be manually released or automatically released by the drill feed mechanism upon retraction of the drill holder to facilitate lowering of the carriage.

More particularly, the upright standard includes a tubular standard post having a foot plate adapted to rest on a fixed surface opposite the overhead workpiece and which permits forward and rearward tilting of the standard post while providing lateral stability. The carriage includes a first tubular portion slidably sleeved on such standard post and a second tubular portion in which slides a tubular drill holder draw post on which the drill is mounted. The feed mechanism includes a generally horizontal lever pivoted medially to the carriage and a linkage connecting one end of the lever to the draw post whereupon pivotal movement of the lever effects advancement and retraction of the draw post and thus the drill mounted thereon. The lock mechanism includes a friction lock member which is pivotally carried on the carriage and which has an aperture through which passes the smaller diameter standard post. The lock member normally is biased by the weight of the carriage to a cocked position that effects binding engagement between the lock member and standard post to prevent downward movement of the carriage resting on the lock member. Upon lifting of the carriage, the lock member is caused to move to a released position permitting movement of the lock member on the post and thus continued upward movement of the carriage as well. The lock member also may be manually released or automatically released upon engagement therewith by the lever upon retraction of the drill.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DETAILED DESCRIPTION

Figure 1:
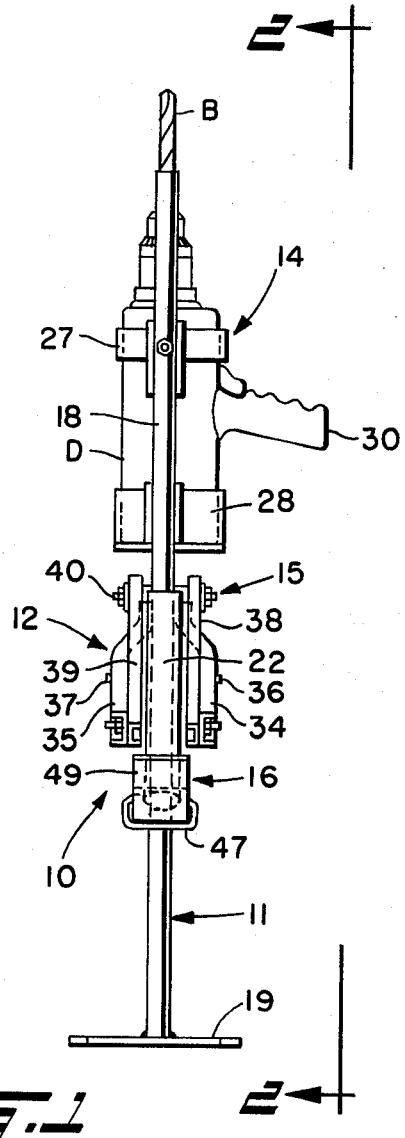
FIG. 1 is a front elevation of a preferred form of jig assembly according to the invention.
Figure 2:
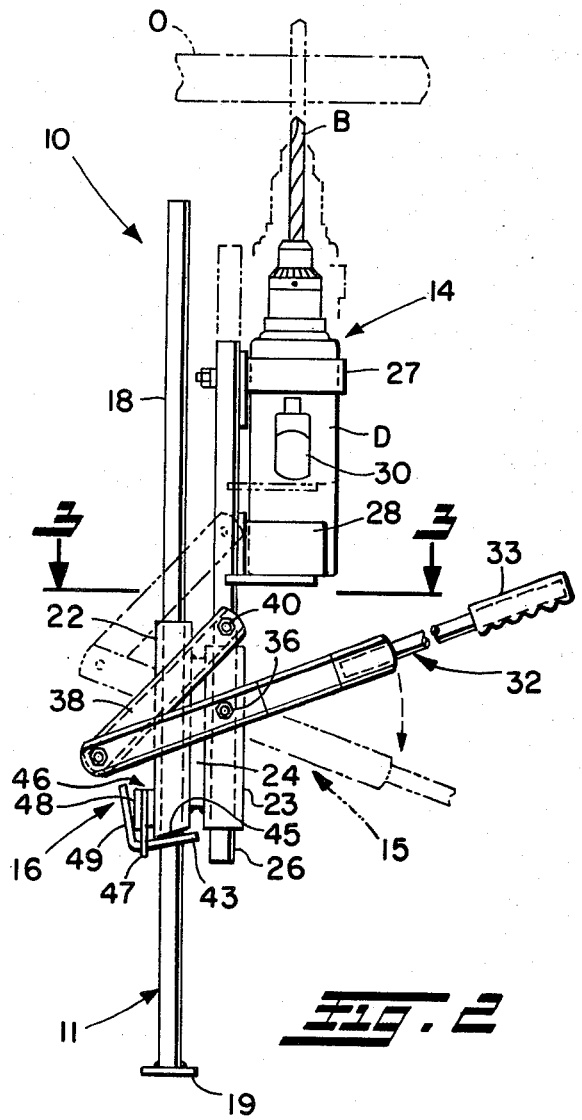
FIG. 2 is a side elevation of the jig assembly of FIG. 1 as viewed from the line 2—2 thereof.
Figure 3:
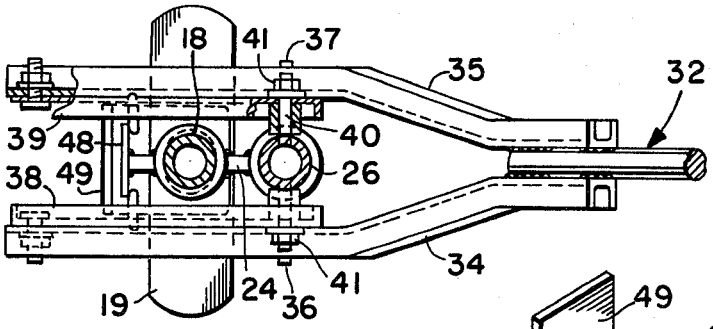
FIG. 3 is an enlarged horizontal section through the jig assembly taken on the line 3—3 of FIG. 2.

Referring now in detail to the drawing and initially to FIGS. 1-3, a drill jig assembly according to the invention is designated generally by reference numeral 10. The drill jig assembly 10 generally includes an upright standard 11, a carriage 12, a drill holder 14, a drill feed mechanism 15 and a releasable lock mechanism 16, all of which hereinafter are described in greater detail.

As illustrated, the upright standard 11 consists of a post 18, which preferably is tubular and circular in cross section, and a footplate 19. The footplate 19 is secured such as by welding to the base of the post and extends laterally of the post in opposite directions so that when the footplate is supported on a flat support surface, it stabilizes the post against lateral swinging or swaying movement. On the other hand, the footplate is narrow as seen in FIG. 2 so that the post can be slightly tilted both forwardly and rearwardly with the footplate acting as the pivot. As will be appreciated, this permits adjustment of the drilling angle relative to the overhead workpiece in which a hole is to be drilled.

The carriage 12 is slidably mounted on the upright standard 11 and includes a pair of tubular portions 22 and 23 which are secured together by web piece 24 and which preferably have their respective axes being parallel to each other. The tubular portion 22 is slidably sleeved on the standard post 18 whereby the carriage, and also the drill holder 14 and drill feed mechanism 15 supported on the carriage, may be vertically adjusted along the standard post.

The drill holder 14 is mounted on the carriage 12 by means of a depending tubular draw post 26. The lower end of the draw post 26 slides in the tubular portion 23 of the carriage whereas the upper end has a power drill D mounted thereon by attachments 27 and 28. The particular means by which the drill is mounted on the draw post 26 may vary as long as the power drill is securely held thereon with the drill bit axis extending parallel to the axis of the draw post 26. As indicated in FIGS. 1 and 2, the drill preferably is mounted on the draw post with the handle 30 of the drill extending laterally, i.e., parallel to the longitudinal axis of the footplate 19.

Still referring to FIGS. 1–3, the drill feed mechanism 15 can be seen to include a generally horizontal forked lever 32. The lever 32 has a handle 33 and laterally spaced arms 34 and 35 that pass on opposite sides of the carriage 12 and which are pivotally secured to the carriage by trunnion bolts 36 and 37 at the tubular portion 23. Pivotally secured to the ends of such arms opposite the lever handle 33 are the lower ends of respective linkage members 38 and 39 which have their upper ends secured by an axle bolt 40 and fasteners 41 to the draw post 26. The axle bolt 40, in addition to effecting the indicated pivot connection, may also form a retraction stop for the draw post, such axle engaging the top of the tubular portion 23 of the carriage 12.

Figure 5:
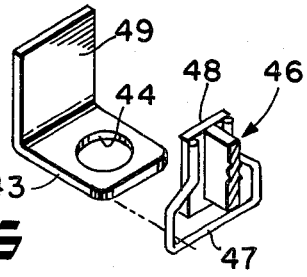
FIG. 5 is an enlarged, exploded and fragmentary perspective view of the releasable lock mechanism.
Figure 4:
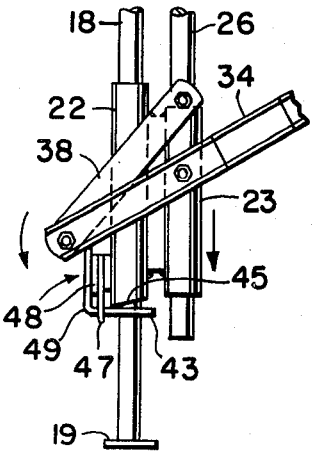
FIG. 4 is an enlarged fragmentary portion of FIG. 2 showing the releasable lock mechanism of the jig assembly being automatically released.

Referring now additionally to FIGS. 4 and 5, the releasable lock mechanism 16 can be seen to include a friction lock or stop member 43 which has an aperture 44 through which passes the standard post 18. As the standard post is circular in cross section, the aperture 44 also preferably is circular but of a diameter greater than that of the standard post so that the lock member 43 can slide freely on the standard post when the axis of the aperture is substantially parallel to the axis of the standard post. The diameter of the aperture however is only slightly greater than that of the standard post so that when the lock member is cocked to the axis of the post as seen in FIG. 2, such lock member at the sides of the aperture will bind against the standard post so as to preclude movement of the lock member along the standard post.

Normally, the friction lock member 43 will be biased to such cocked or pivoted position by the weight of the carriage 12 by means of the inclined end face 45 at the lower end of the tubular portion 22. When the carriage is lowered against the lock member, such end face, being inclined to the axis of the standard post 18, will bear against and cause the lock member to pivot to its cocked position thereby to lock the lock member to the standard post. This accordingly will preclude further downward movement of the carriage which rests on the thusly locked lock member.

The friction lock member 43 is pivotally carried on the carriage 12 by a retainer member 46 secured to the lower end of the tubular portion 22 of the carriage. Such retainer member includes a wire ring 47 that loosely encircles the lock member 43 adjacent the standard post 18 so as to hold the lock member to the carriage while permitting slight pivotal movement thereof relative to the carriage and the standard post as well.

The wire ring 47 is positioned in relation to the lock member 43 so that upon elevation of the carriage 12, such wire ring will engage the lowermost portion of the lock member when cocked and cause the lock member to pivot to its released position seen in FIG. 4 which permits free sliding movement of the lock member along the standard post 18. Accordingly, as the carriage is raised, the lock member is caused to be released from its cocked or locked position to permit continued upward movement of the carriage with the lock member moving along therewith. Over-pivoting of the lock member, which would cause it to be reversely cocked and bind against the standard post so as to preclude such continued upward movement of the lock member and carriage, is prevented by a release stop plate 48 fixed to the carriage and a release arm 49 on the lock member. As seen in FIG. 4, the stop plate is parallel to the axis of the standard post whereas the release arm is parallel to the axis of the aperture 44. Accordingly, upon engagement of the release arm with the stop plate, the ring is oriented so as to permit free sliding movement thereof along the standard post.

It now can be appreciated that the releasable lock mechanism 16 prevents downward movement of the carriage 12 on the standard 11 while permitting upward movement of the carriage on the standard so that the carriage may be selectively positioned on the standard simply by lifting the carriage to the proper vertical height and then released to lock same in place.

It also can be appreciated that the friction lock member 43 may be released or, more accurately, rendered inoperative by manually depressing the release arm 49 against the release stop plate 48. When thus manually released, the carriage 12 can be adjusted downwardly as well as upwardly along the standard post 18.

Alternatively, the friction lock member 43 may be released automatically by operation of the lever 32. As seen in FIG. 4, the lever 32 and release arm 49 are arranged so that upon continued counterclockwise rotation of the lever during retraction of the drill holder 14, the forked end of the lever will engage the release arm and move same into engagement with the stop plate 48 thereby to move the lock member to its released position. Accordingly, the drill holder 14 may be retracted and the lock member released in a single upward motion of the lever. It also should be appreciated that an upward force is applied to the handle during retraction of the drill holder so that when the lock member is released, the operator can continuously maintain the lock member in its released condition and controllably lower the carriage 12.

In use, the power drill D first is mounted on the draw tube 26 of the drill holder 14 in the indicated manner. With the drill holder in its retracted position seen in solid lines in FIG. 2, the jig assembly may be positioned below the overhead workpiece O in which a hole is to be drilled and the carriage 12 elevated on the standard post to a vertical height placing the drill or, more accurately, the drill bit B closely adjacent the workpiece. If needed, the jig assembly may be shifted as necessary to align the drill with the workpiece and tilted forwardly or rearwardly as required to provide the desired drilling angle. The drill then may be turned on and pressure applied by the operator to the handle 33 in the downward direction thereby advancing the drill upwardly toward the workpiece to effect drilling of the hole in the overhead workpiece. If the jig assembly is to be tilted at a substantial angle to the floor or other support, the operator may place one or both feet on the foot plate 19 to hold the same against slippage.

It should be appreciated that substantial force may be applied by the feed mechanism 15 to the drill D during the drilling operation due to the mechanical advantage gained by the lever arm 32. Moreover, such force is being applied conveniently in a downward direction.

When the hole is drilled, the handle 33 may be raised to retract the power drill D and withdraw the drill bit B from the workpiece O. Actually, very minimal force may be needed as the weight of the drill will tend to cause the drill to retract on its own. In the same lifting motion of the handle, the operator may also cause the lever to engage the releasable lock mechanism 16 at the release arm 49 so as to release the lock member 43 and permit controlled and easy lowering of the carriage 12. Thereafter, the jig assembly can be moved to a new position to effect drilling of another hole.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A portable jig assembly for supporting a power drill and for advancing and retracting the drill towards and away from an overhead workpiece to drill a hole therein, comprising an upright standard, a carriage mounted for vertical movement on said standard, a drill holder mounted on said carriage for vertical movement relative to said carriage, said holder being adapted to support a power drill for movement therewith, feed means on said carriage and cooperative with said holder to advance and retract the holder so that a drill supported by said holder may be caused to drill a hole in the workpiece and thereafter be removed from the workpiece, releasable lock means in cooperative relation with said carriage and standard for preventing downward movement of said carriage on said standard while permitting upward movement of said carriage on said standard whereby said carriage may be selectively positioned on said standard by lifting same and then released to lock same in place, and means for releasing said releasable lock means to permit downward movement of said carriage, said feed means including means cooperative with said means for releasing to effect release of said releasable lock means upon retraction of said drill holder.

2. The assembly of claim 1 wherein said standard includes a post and said carriage includes a tubular portion slidably sleeved on said post.

3. The assembly of claim 2 wherein said releasable lock means includes a friction lock member having an aperture through which said post passes, said aperture having a diameter slightly greater than that of said post so that said lock member can slide freely on said post when the axis of said aperture is substantially parallel to the axis of said post, and means normally for pivoting said lock member to a cocked position and into binding friction engagement with said post.

4. The assembly of claim 3 wherein said lock member is pivoted to such cocked position by the weight of said carriage.

5. The assembly of claim 4 wherein said means normally for pivoting includes an inclined lower end face on said tubular portion adapted to engage and bear against said lock member to cause same to pivot to such cocked position.

6. The assembly of claim 4 including means for pivotally carrying said lock member on said carriage.

7. The assembly of claim 6 wherein said means for pivotally carrying includes a wire ring on said carriage that loosely encircles said lock member adjacent said post.

8. The assembly of claim 6 including a release stop on said carriage and a release arm on said lock member cooperative when engaged to define a release position for said lock member permitting free sliding movement thereof on said post.

9. A portable jig assembly for supporting a power drill and for advancing and retracting the drill towards and away from an overhead workpiece to drill a hole therein, comprising an upright standard, a carriage mounted for vertical movement on said standard, a drill holder mounted on said carriage for vertical movement relative to said carriage, said holder being adapted to support a power drill for movement therewith, feed means on said carriage and cooperative with said holder to advance and retract the holder so that a drill supported by said holder may be caused to drill a hole in the workpiece and thereafter be removed from the workpiece, releasable lock means in cooperative relation with said carriage and standard for preventing downward movement of said carriage on said standard while permitting upward movement of said carriage on said standard whereby said carriage may be selectively positioned on said standard by lifting same and then released to lock same in place, said standard including a post and said carriage including a tubular portion slidably sleeved on said post, said releasable lock means including a friction lock member having an aperture through which said post passes, said aperture having a diameter slightly greater than that of said post so that said lock member can slide freely on said post when the axis of said aperture is substantially parallel to the axis of said post, means normally for pivoting said lock member to a cocked position and into binding friction engagement with said post, said means normally for pivoting including an inclined lower end face on said tubular portion adapted to engage and bear against said lock member to cause same to pivot to such cocked position, and a release stop on said carriage and a release arm on said lock member cooperative when engaged to define a release position for said lock member permitting free sliding movement thereof on said post, said feed means including a lever pivoted on said carriage, means connecting one end of said lever to said drill holder for advancement and retraction of said drill holder in response to lowering and raising of the other end of said lever, respectively, said one end of said lever being arranged to engage said release arm and urge same into engagement with said release stop upon raising of said other end of said lever.

10. A portable jig assembly for supporting a power drill and for advancing and retracting the drill towards and away from an overhead workpiece to drill a hole therein, comprising a standard post, a drill holder including a depending draw post, a carriage including a first tubular portion slidably sleeved on said standard post and a second tubular portion within which slides said draw post, means for mounting a drill on said draw post, lock means for locking said carriage on said standard post at any adjusted position, feed means on said carriage for advancing and retracting said draw post, said feed means including a lever pivoted on said carriage and a linkage connecting one end of said lever to said drill holder for advancement and retraction of said drill holder in response to lowering and raising of the other end of said lever, respectively, said lock means being movable from a locked position locking said carriage on said standard post to a released position premitting free sliding movement of said carriage on said standard post, and means engageable by said one end of said lever upon raising of the other end of said lever for moving said lock means to such released position.

11. The assembly of claim 10 including a foot plate supporting said standard post, said foot plate extending laterally of said standard post in opposite directions and being narrow so that said standard post can be slightly tilted both forwardly and rearwardly with said foot plate acting as the pivot therefor.

12. The assembly of claim 10 in combination with a power drill mounted on said draw post with its bit axis extending parallel to the axis of said draw post.

* * * * *